US005546872A

United States Patent [19]

Young

[11] Patent Number: 5,546,872

[45] Date of Patent: Aug. 20, 1996

[54] PLASTIC PALLET

[76] Inventor: Joseph R. Young, 625 Atlanta St., Metairie, La. 70003

[21] Appl. No.: 377,142

[22] Filed: Jan. 23, 1995

[51] Int. Cl.[6] ..... B65D 19/12

[52] U.S. Cl. ..... 108/56.1; 108/902

[58] Field of Search ..... 108/51.1, 56.1, 108/56.3, 901, 902

[56] References Cited

U.S. PATENT DOCUMENTS

| | | | |
|---|---|---|---|
| 3,481,285 | 12/1969 | Yellin . | |
| 3,667,403 | 6/1972 | Angelbeck, Jr. . | |
| 3,685,461 | 8/1972 | Belcher | 108/51.1 |
| 3,699,902 | 10/1972 | Allgeyer et al. . | |
| 3,795,206 | 3/1974 | Utz . | |
| 3,868,915 | 3/1975 | Hafner | 108/51.1 |
| 3,938,448 | 2/1976 | Nishitani et al. | 108/51.1 |
| 4,133,270 | 1/1979 | Ravera . | |
| 4,403,555 | 9/1983 | Forrest . | |
| 4,735,154 | 4/1988 | Hemery | 108/51.1 X |
| 4,843,976 | 7/1989 | Pigott et al. . | |
| 4,879,956 | 11/1989 | Shuert | 108/901 X |
| 5,197,396 | 3/1993 | Breezer et al. . | |
| 5,359,955 | 11/1994 | Grebenyuk | 108/51.1 |
| 5,388,533 | 2/1995 | Pigott et al. | 108/56.1 X |

*Primary Examiner*—Jose V. Chen
*Attorney, Agent, or Firm*—Joseph N. Breaux

[57] ABSTRACT

A plastic pallet having a top pallet section and a base pallet section secured together with bolt and nut type fasteners to form a longitudinal and a transverse skid passageway. Each of the nut and bolt type fasteners is locked in place by a plurality of deformable locking flaps disposed within a locking mechanism recess. The base pallet section includes a surface having a plurality of interconnecting channels formed therein for channeling water in any direction. The top pallet section includes four observation apertures positioned to allow simultaneous viewing of a longitudinal and a transverse skid passageway.

1 Claim, 7 Drawing Sheets

PLASTIC PALLET

TECHNICAL FIELD

The present invention relates to devices for supporting and transporting items and more particularly to pallets which have both longitudinal and transverse skid passageways, bases which channel fluids away, and mechanisms for holding securing bolts and nuts in their fastened position.

BACKGROUND ART

For many years it has been a widespread practice to use wooden pallets for the storage and transporting of large containers such as barrels, kegs and the like. Wooden pallets are used in almost every facet of manufacturing and delivery.

However, there are a number of drawbacks to the use of wooden pallets, particularly in the realm of economics and practicability. From a practicability standpoint, wooden pallets are difficult to maintain and after a period of time, are rendered ineffective for use when subject to normal abuse in the trade. Furthermore, where wooden pallets are subject to contact with liquid substances, the wood can rapidly deteriorate. From an economic standpoint, the wooden pallets have a shorter life than pallets formed of other materials and in addition are more costly in terms of purchase price than pallets formed of non-wooden materials.

Many problems are inherent in the use of wooden pallets in a wide variety of applications. The wooden pallets are constructed by placing the frame members and cover boards in the desired locations and securing the same by means of nails or staples. However, after some use, these metal securement means are ultimately urged out of their point of securement thereby rendering the pallet defective. Vibration, which often results from carrying the pallets on a moving vehicle, causes the nails or other metal fasteners to work out of their fastening positions. Furthermore, the wooden pallets have a substantially greater weight than a plastic pallet constructed of substantially equal size. Consequently, freight costs are higher when wooden pallets are employed over plastic counterpart pallets.

There are other less obvious, but nevertheless, serious disadvantages in the use of wooden pallets. The fibrous nature of wood used in the wooden pallets does not readily lend the pallets to complete sterilization, which may be desirable in many applications. For example, when pallets are exposed to caustic substances such a common industrial acids and the like. A single exposure to these caustic substances not only reduces the commercial life of wooden pallets but often prohibits any further use. In addition, wooden pallets are limited to either a longitudinal or transverse skid passageway. Thus, access to the wooden pallet and its load is limited to two of the four potential directions.

It would be a benefit, therefore, to have a pallet which has a locking mechanism which maintains the means securing the pallet in a rigid structure in a fastened position. It would be further benefit to have a pallet constructed of a plastic which does not deteriorate when contacted by an array of common fluids. It would be an additional benefit, to have a pallet with a base which channels fluids away from the pallet. It would also be of a benefit to have a pallet accessible by a fork lift through both longitudinal and transverse skid passageways.

GENERAL SUMMARY DISCUSSION OF INVENTION

It is thus an object of the invention to provide a plastic pallet that has a bolt locking mechanism which maintains a bolt in its fastened position.

It is a further object of the invention to provide a plastic pallet that has longitudinal and transverse skid passageways.

It is a still further object of the invention to provide a plastic pallet that has a base which channels fluids away from the pallet.

It is a still further object of the invention to provide a plastic pallet that has skid observation apertures.

Accordingly, a plastic pallet is provided of the type having a top pallet section and a base pallet section adapted to receive items thereon and for transporting these items by use of a fork lift. The improvement to the plastic pallet comprises: the addition of observation apertures to the top pallet section, a plurality of bolt-locking mechanisms and a plurality of bolt and nut fasteners.

The bolt and nut fasteners pass through the bolt-locking mechanisms securing the top pallet section and the base pallet section together thereby forming a rigid structure. The bolt-locking mechanism prevents the nut and bolt connection from loosening.

The top pallet section has a first surface which is substantially planar and adapted to receive items structures thereon.

In a preferred embodiment, the pallet may have a longitudinal or transverse skid passageway. The pallet may have both a longitudinal and transverse skid passageways. The skid passageway passes the length of the pallet. The skid passageway is of a width sufficient to accommodate the skids of a fork lift. The observation apertures are aligned over the passageways allowing observation of the placement of the fork lift skids.

The base pallet section is a waffle section constructed of perpendicularly oriented members. This section allows fluid to be channeled past the plastic pallet.

A bolt locking mechanism is a bolt locking recess located on the first surface of the top pallet section. The recess is of a diameter sufficient to accommodate a bolt or nut with a superimposed socket. The recess is of a depth such that the bolt is flush with the first surface of the top pallet section. The bolt locking mechanism has a bolt passageway passing through the top pallet section and the bolt locking recess. The recess has a plurality of radiating members extending vertically therein. The radiating members have a deformable locking flap extending vertically therefrom. When the nut and bolt are secured the locking flaps are deformed, frictionally securing the nut and bolt in place.

In another preferred embodiment of the plastic pallet, the top pallet section has a first surface adapted to receive load bearing structures thereon. The top pallet section has a second surface having a plurality of leg members extending vertically therefrom. The base pallet section has a like number of leg members extending vertically therefrom. The top leg members and base leg members are aligned in a manner such that a longitudinal skid passageway is formed. The top leg members and base leg members are aligned in a manner that a transverse skid passageway is formed. The top pallet section has observation apertures aligned over the skid passageways.

The base pallet section is a waffle section constructed of perpendicularly oriented members. The waffle section facilitates passing fluids past the plastic pallet.

A plurality of bolt-locking mechanisms are located along the first surface of the top pallet section. The bolt locking mechanisms are a bolt locking recesses located on the first surface of the top pallet section opposite the top leg members. A bolt locking mechanism has a bolt passageway passing through the bolt locking recess a top leg member and the top pallet section and a base leg member and the base pallet section. A bolt locking recess has a plurality of radiating members extending vertically therein. Deformable locking flaps extend vertically from each radiating member.

Bolts extend through the bolt locking recesses and the bolt passageways in a manner such that threading the nut on the bolt deforms the locking flaps locking the bolt in place.

In another preferred embodiment of the plastic pallet, the top pallet section has a first surface adapted to receive load bearing structures thereon. The top pallet section has a second surface having a plurality of leg members extending vertically therefrom. The base pallet section has a like number of leg members extending vertically therefrom. The top leg members and base leg members are aligned in a manner such that a longitudinal skid passageway is formed. The top leg members and base leg members are aligned in a manner such that a transverse skid passageway is formed. The top pallet section has observation apertures aligned over the skid passageways.

The base pallet section is a waffle section constructed of perpendicularly oriented members. The waffle section facilitates passing fluids past the plastic pallet.

A plurality of bolt-locking mechanisms are located along the first surface of the top pallet section and along an exterior surface of base pallet section. The bolt locking mechanisms are bolt locking recess located opposite the top leg members and the base leg members. A bolt locking mechanism has a bolt passageway passing through the bolt locking recesses and a top leg member and the top pallet section and a base leg member and the base pallet section. A bolt locking recess has a plurality of radiating members extending vertically therein. Each radiating member has a deformable locking flap extending vertically therefrom.

Bolts extend through the bolt locking recesses and the bolt passageways in a manner such that threading the nut on the bolt deforms the locking flaps locking the bolt in place.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
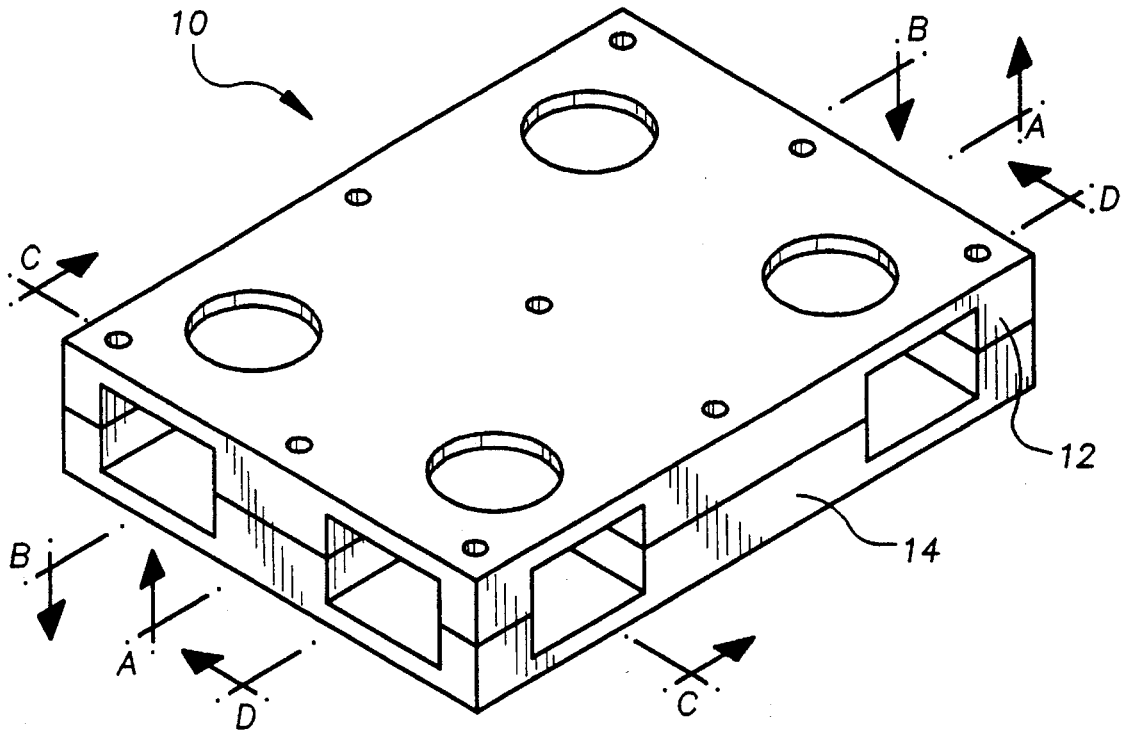
FIG. 1 is an isometric view of an exemplary embodiment of the improved plastic pallet.

FIG. 1 is an isometric view of an exemplary embodiment of the improved plastic pallet of the present invention generally designated by the numeral 10. 10 designates a pallet which comprises a top pallet section 12 and a base pallet section 14. Each of the pallet forming sections are facewise disposed upon each other in marginal registration in the manner as illustrated in FIG. 1, and are secured together in such position.

Figure 2:
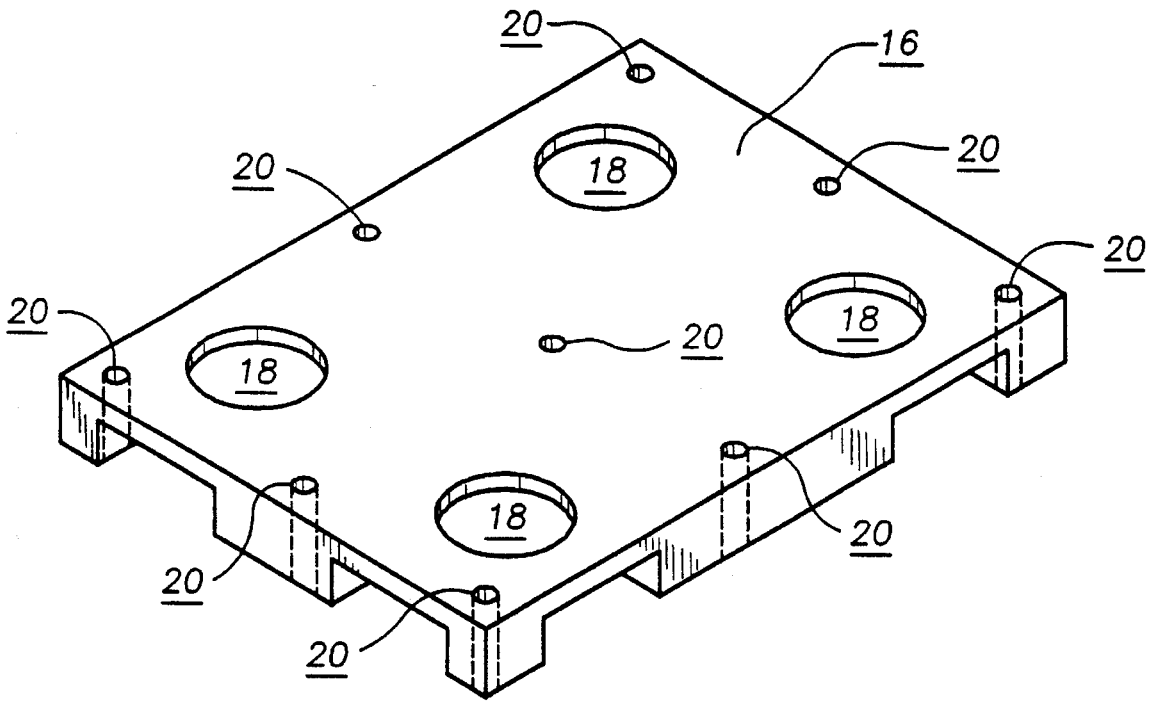
FIG. 2 is an isometric view of the top pallet section.

FIG. 2 is an isometric view of top pallet section 12. Top 12 is formed of unitary construction from a suitable plastic using a molding technique. Top 12 includes a planar section 16, which is capable of receiving items thereon. Planar section 16 includes four observation apertures 18 and nine bolt locking recesses 20.

Figure 3:
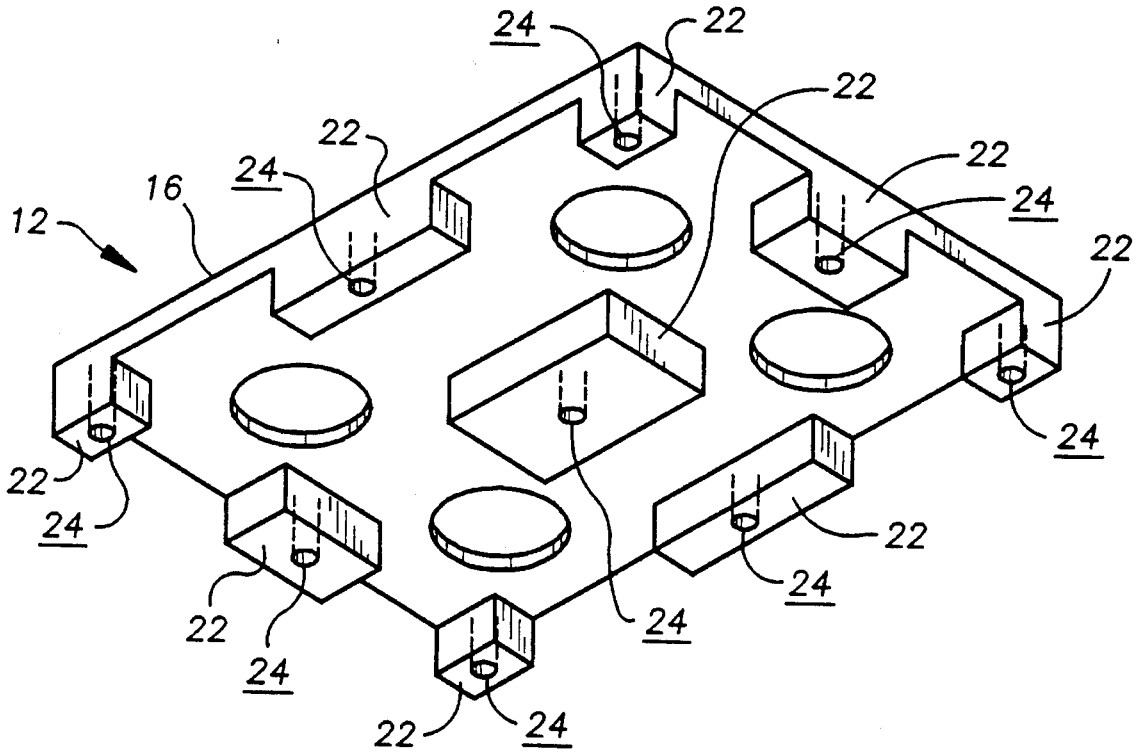
FIG. 3 is an isometric view of the top pallet section along the line A—A shown in FIG. 1.

FIG. 3 is an isometric view of top pallet section 12 along the line A—A shown in FIG. 1. The figure show nine top leg members 22 extending perpendicularly from planar section 16. Each leg member 22 having a bolt passageway 24 centered therethrough and concentrically connected with bolt locking recesses 20 (shown in FIG. 2).

Figure 4:
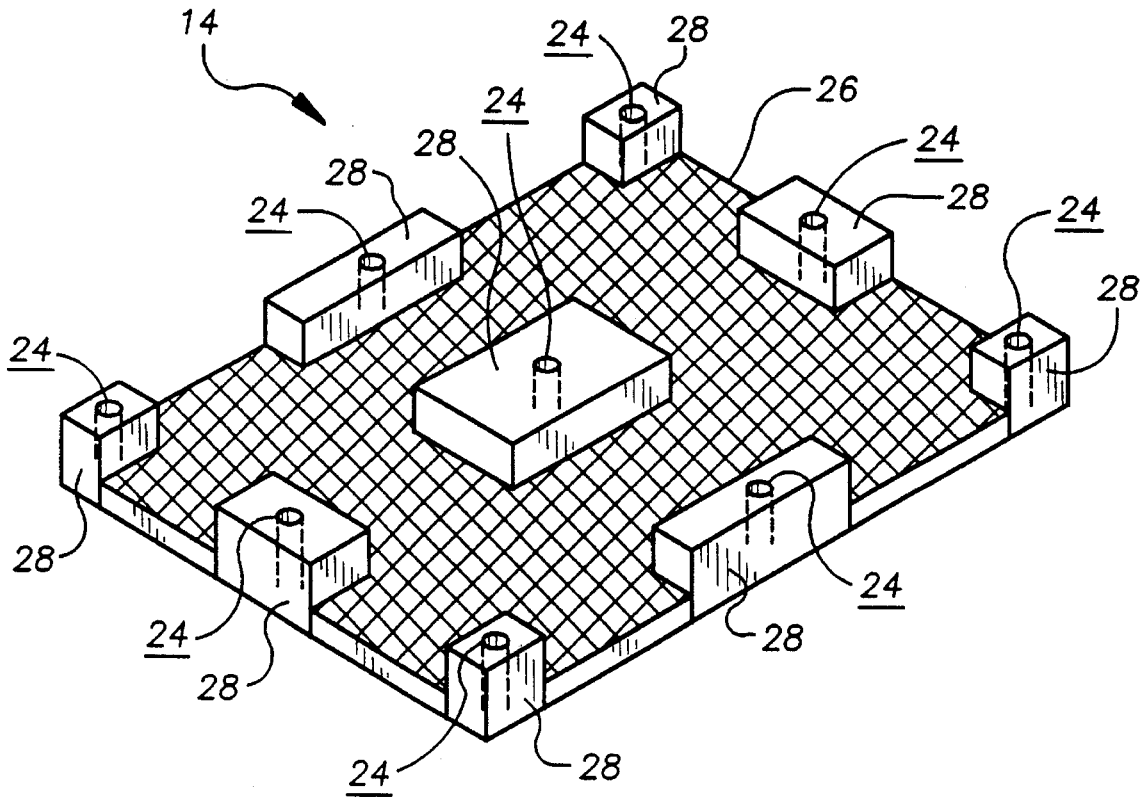
FIG. 4 is an isometric view of the base pallet section along the line B—B shown in FIG. 1.

FIG. 4 is an isometric view of base pallet section 14 along the line B—B shown in FIG. 1. Base section 14 is formed of unitary construction from a suitable plastic using a molding technique and is of the same dimensions as top pallet section 12. Base 14 includes waffle section 26. Extending perpendicular from waffle section 26 are nine base leg members 28. Each base leg member 28 having a bolt passageway 24 centered therethrough and concentrically connected with bolt locking recesses 20 (shown in FIG. 5).

Figure 5:
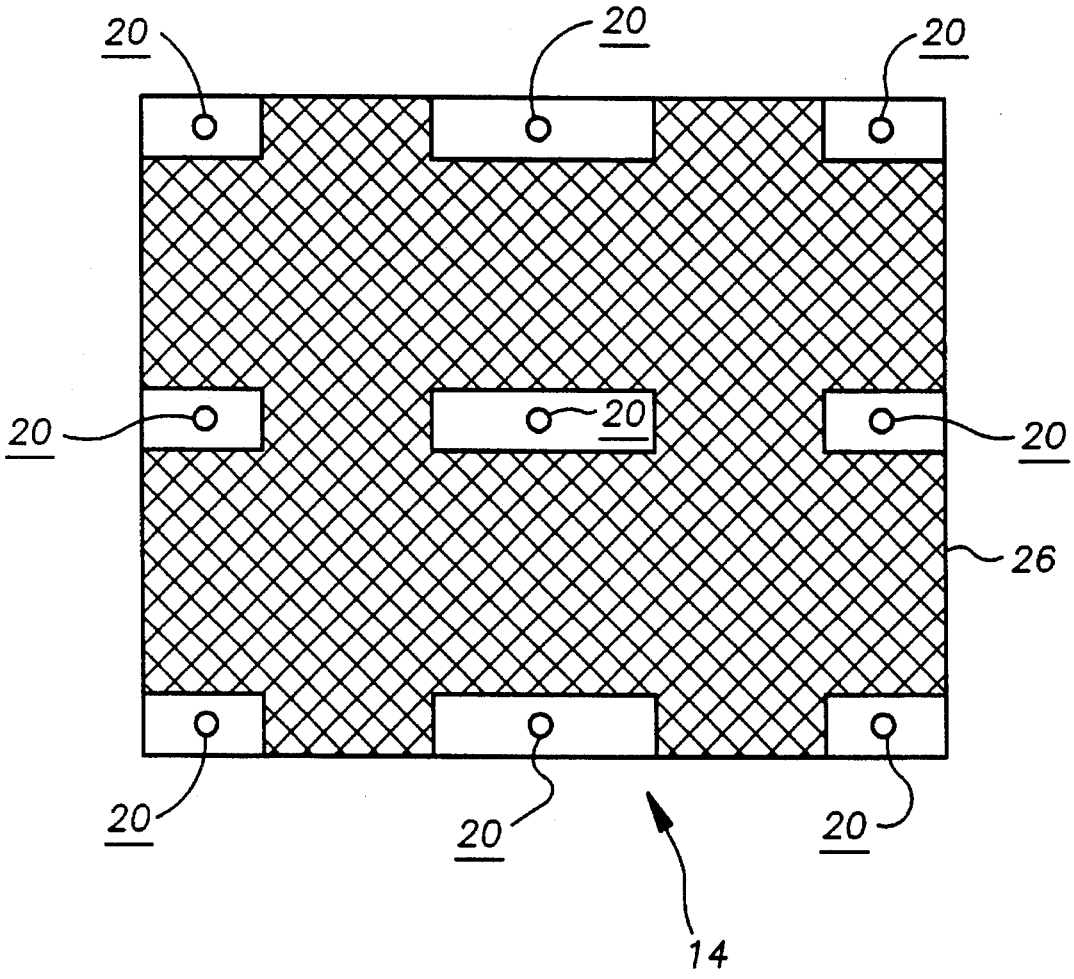
FIG. 5 is a bottom view of the base pallet section.

FIG. 5 is a bottom view of base pallet section 14. The figure shows waffle section 26 disposed to channel fluids away from plastic pallet 10, and bolt locking recesses 20.

Figure 6:
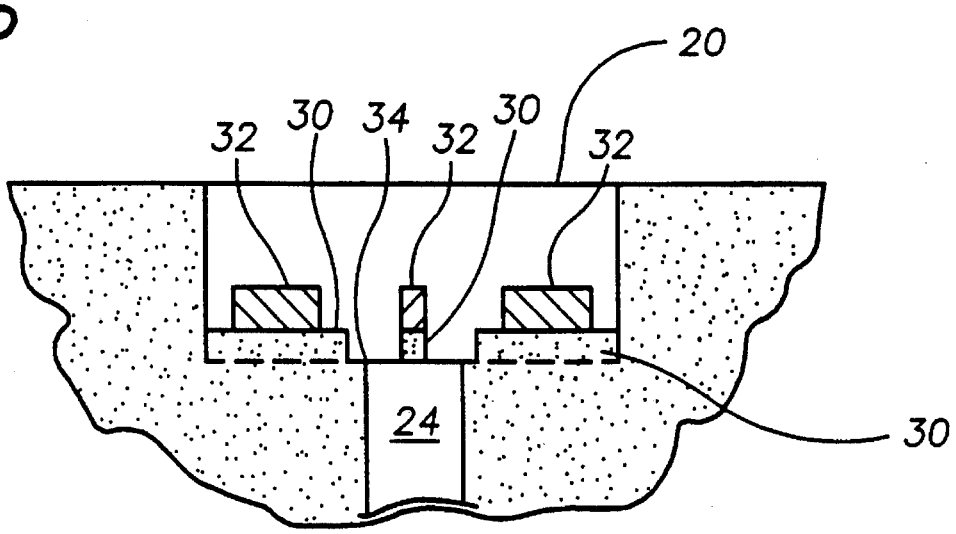
FIG. 6 is a cross-sectional view in isolation of a bolt locking recess and a bolt passageway.

FIG. 6 is a cross-sectional view in isolation of bolt locking recesses 20 and bolt passageway 24. Bolt locking recess 20 includes eight radiating members 30 and eight locking flaps 32. Radiating members 30 extend vertically from passageway lip 34. Locking flaps 32 extend vertically from radiating members 30.

Figure 7:
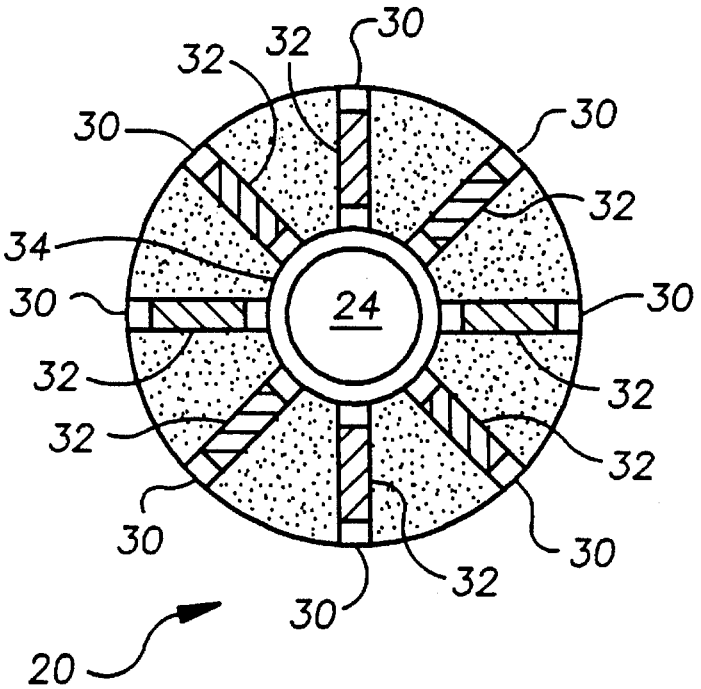
FIG. 7 is a top view in isolation of a bolt locking recess and a bolt passageway.

FIG. 7 is a top view in isolation of bolt locking recess 20 and bolt passageway 24. The figure shows radiating members 30 and locking flaps 32 radiating from passageway lip 34 spaced forty-five degrees apart.

Figure 8:
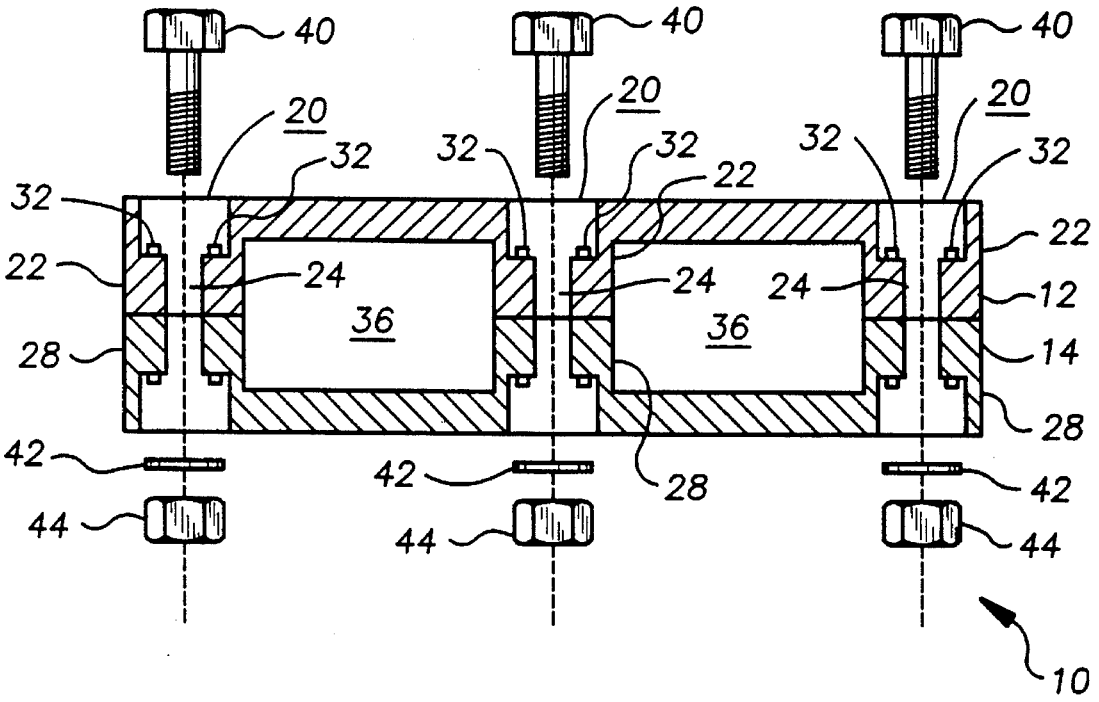
FIG. 8 is a cross-sectional, front view of the plastic pallet along the line C—C shown in FIG. 1.

FIG. 8 is a cross-sectional, front view of pallet 10 along the line C—C shown in FIG. 1. The figure shows longitudinal skid passageways 36 formed when top section 12 and base section 14 are disposed facewise with top legs 22 and bottom legs 28 are aligned. Top 12 and bottom 14 are secured by bolts 40, washer 42 and nut 44. Bolt 40 is inserted into bolt locking opening 20 and extending through bolt passageway 24. When bolt 40 is secured, with washer 42 and nut 44, locking flaps 32 are deformed locking bolt 40 and nut 44 in place.

Figure 9:
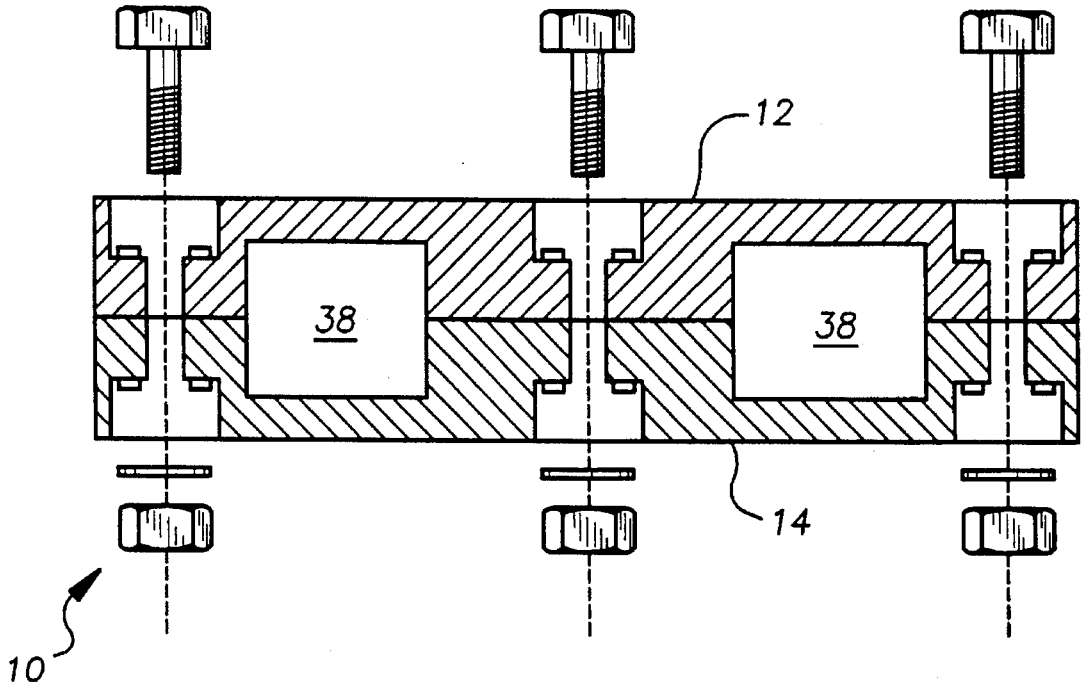
FIG. 9 is a cross-sectional, side view of the plastic pallet along the line D—D shown in FIG. 1.

FIG. 9 is a cross-sectional, side view of pallet 10 along the line D—D shown in FIG. 1. The figure shows transverse skid passageways 38 formed when top section 12 and base section 14 are secured with top legs 22 and bottom legs 28 aligned.

It can be seen from the preceding description that a method and device for providing a plastic pallet with longitudinal and transverse skid passageways with observation apertures which allow checking fork lift skids for alignment, a pallet base which channels fluids away from the pallet and a mechanism for locking the securing bolts in place has been provided.

It is noted that the embodiment of the plastic pallet described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A plastic pallet of the type having a top pallet section and a base pallet section adapted to receive load bearing structures thereon and facilitating transportation by use of a fork lift, the improvement comprising:

a) said top pallet section having a first surface, second surface and four observation apertures, said second surface of said top pallet section having nine top leg members extending vertically therefrom;

b) a base pallet section having a unitary waffle section having a third surface having a plurality of interconnecting channels formed therein and a fourth surface having nine base leg members extending vertically therefrom, said top leg members and said base leg members being aligned in a manner such that a longitudinal skid passageway and a transverse skid passageway are formed between said second surface of said top pallet section and said base pallet section, and each of said four observation apertures is positioned in a manner to allow simultaneous viewing of one longitudinal skid passageway and one transverse skid passageway;

c) nine top bolt-locking mechanisms formed within said top pallet section, each said top bolt-locking mechanism including a top bolt-locking recess formed into said first surface of said top pallet section, a top bolt passageway passing through said top bolt locking recess and one of said nine top leg members, and eight radiating members extending vertically within the top bolt-locking recess, each radiating member having a deformable locking flap extending vertically therefrom;

d) nine base bolt-locking mechanisms formed within said base pallet section, each said base-locking mechanism including a base bolt-locking recess formed into said third surface of said base pallet section, a base bolt passageway passing through said base bolt locking recess and one of said nine base leg members, and eight radiating members extending vertically within the base bolt-locking recess, each radiating member having a deformable locking flap extending vertically therefrom; each said base bolt passageway being in alignment with one of said top bolt passageways when said top leg members and said base leg members are aligned in a manner such that a longitudinal skid passageway and a transverse skid passageway are formed between said second surface of said top pallet section and said base pallet section; and nine bolt and nut type fasteners having a threadably connectable bolt and nut, each of said nine bolts extending through one of said aligned top and base locking-bolt passageways in a manner such that a head portion of said bolt is entirely disposed within a said top bolt-locking recess, each of said nine nuts being threaded onto one of said nine bolts in a manner such that each said nut is entirely disposed within one of said base bolt-locking recess and each of said eight deformable locking flaps within each of said top and base bolt-locking recesses is deformed sufficiently to exert a locking force against one of said nine bolt and nut type fasteners.

* * * * *